United States Patent [19]

Mifune et al.

[11] Patent Number: 4,631,253

[45] Date of Patent: Dec. 23, 1986

[54] METHOD FOR FORMING SILVER HALIDE EMULSION COMPRISING FORMING SILVER HALIDE GRAINS IN THE PRESENCE OF MESOIONIC 1,2,4-TRIAZOLIUM-3-THIOLATE COMPOUND

[75] Inventors: Hiroyuki Mifune; Koki Nakamura; Shoji Ishiguro, all of Kanagawa, Japan

[73] Assignee: Fuji Photo Film Co., Ltd., Kanagawa, Japan

[21] Appl. No.: 697,825

[22] Filed: Feb. 4, 1985

[30] Foreign Application Priority Data

Feb. 3, 1984 [JP] Japan ..... 59-19096

[51] Int. Cl.[4] ..... G03C 1/02; G03C 1/06

[52] U.S. Cl. ..... 430/569; 430/567; 430/611; 430/613

[58] Field of Search ..... 430/567, 569, 611, 613

[56] References Cited

U.S. PATENT DOCUMENTS 4,378,424 3/1983 Altland et al. ..... 430/566

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A photographic material is described, comprising a support and at least one silver halide emulsion layer which contains nearly uniform and large size silver halide grains formed in the presence of a novel silver halide solvent represented by formula (I)

(I)

wherein $R^1$ and $R^2$ each represents an unsubstituted or substituted alkyl group, alkenyl group, cycloalkyl group, aralkyl group, aryl group, or heterocyclic group; $R^3$ represents an unsubstituted or substituted alkyl group, alkenyl group, cycloalkyl group, aralkyl group, aryl group, —$NR^4R^5$, a heterocyclic group; and $R^4$ and $R^5$ each represents a hydrogen atom, an alkyl group or an aryl group; and wherein $R^1$ and $R^2$ or $R^2$ and $R^3$ can combine with each other to form a 5- or 6-membered ring.

6 Claims, No Drawings

METHOD FOR FORMING SILVER HALIDE EMULSION COMPRISING FORMING SILVER HALIDE GRAINS IN THE PRESENCE OF MESOIONIC 1,2,4-TRIAZOLIUM-3-THIOLATE COMPOUND

FIELD OF THE INVENTION

The present invention relates to a photographic material in which a silver halide emulsion is employed, and, more particularly, to a photographic material which contains a silver halide emulsion in which silver halide grains of increased size, prepared in the presence of a novel silver halide solvent, are present.

BACKGROUND OF THE INVENTION

A silver halide emulsion employed in a photographic material is generally prepared by mixing a solution containing silver ion and a solution containing halogen ion(s) in the presence of a hydrophilic colloid (a precipitation step), and then, by ripening the emulsion physically, followed by, in sequence, removal of unnecessary salts from the emulsion by washing, redispersion of the emulsion, and chemical ripening of the emulsion.

The size of the silver halide grains, which is one of factors capable of controlling the sensitivity of a silver halide emulsion, is determined chiefly in the precipitation step and the physical ripening step (these steps are collectively called the grain formation step hereinafter) included in the above-described preparation process. Accordingly, addition of a silver halide solvent in the grain formation step has been carried out with the intention of increasing the grain size. The most typical silver halide solvent used is ammonia, and the grain formation method using ammonia is called the ammonia method. However, ammonia has a pungent odor, and thereby causes health and environmental control problems. In addition, when ammonia is used as a silver halide solvent, large size silver halide grains can be obtained only at a high pH value, and under high pH conditions the fog level of silver halide grains formed becomes high. Furthermore, uniformity in the sizes of silver halide grains formed is insufficient. For the above-described reasons and others, the use of ammonia as a silver halide solvent is undesirable.

SUMMARY OF THE INVENTION

A primary object of the present invention is to provide a photographic material comprising a silver halide emulsion in which silver halide grains are present that have been formed in the presence of silver halide solvent free from defects as described above.

Another object of the present invention is to provide a method for forming uniform and large size silver halide grains using a silver halide solvent having no or only slight odor.

The above-described objects are attained with a photographic material comprising a support and at least one silver halide emulsion layer containing silver halide grains which are formed in the presence of a compound represented by formula (I)

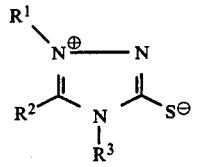

(I)

wherein $R^1$ and $R^2$ each represents an unsubstituted or substituted alkyl group, alkenyl group, cycloalkyl group, aralkyl group, aryl group or heterocyclic group; $R^3$ represents an unsubstituted or substituted alkyl group, alkenyl group, cycloalkyl group, aralkyl group, aryl group, $—NR^4R^5$, or heterocyclic group; $R^4$ and $R^5$ each represents a hydrogen atom, an alkyl group, or an aryl group; and wherein $R^1$ and $R^2$ or $R^2$ and $R^3$ can combine with each other to form a 5- or 6-membered ring.

DETAILED DESCRIPTION OF THE INVENTION

Substituents $R^1$ and $R^2$ in formula (I) include substituted or unsubstituted alkyl groups (e.g., methyl, ethyl, 2-methoxyethyl, 2,2-bismethoxyethyl, 2-methylthioethyl, hydroxyethyl, sulfobutyl, carboxyethyl, etc.), substituted or unsubstituted alkenyl groups (e.g., allyl, etc.), substituted or unsubstituted cycloalkyl groups (e.g., cyclopentyl, cyclohexyl, etc.), substituted or unsubstituted aryl groups (e.g., phenyl, 4-methoxyphenyl, 4-carboxyphenyl, 4-methoxycarbonylphenyl, 3-sulfamoylphenyl, etc.), substituted or unsubstituted aralkyl groups (e.g., benzyl, etc.), and substituted or unsubstituted heterocyclic groups (e.g., 2-pyridyl, 2-furyl, etc.). Of these groups, those containing not more than 16 carbon atoms in total are more desirable.

The substituent R3 includes substituted or unsubstituted alkyl groups (e.g., methyl, ethyl, 2-methoxyethyl, 2,2-bismethoxyethyl, 2-methylthioethyl, hydroxyethyl, sulfobutyl, carboxyethyl, etc.), substituted or unsubstituted alkenyl groups (e.g., allyl, etc.), substituted or unsubstituted cycloalkyl groups (e.g., cyclopentyl, cyclohexyl, etc.), substituted or unsubstituted aryl groups (e.g., phenyl, 4-methoxyphenyl. 4-carboxyphenyl, 4-methoxycarbonylphenyl, 3-sulfamoylphenyl, etc.), substituted or unsubstituted aralkyl groups (e.g., benzyl, etc.), substituted or unsubstituted heterocyclic groups (e.g., 2-pyridyl, 2-furyl, etc.), and groups of the formula $—NR^4R^5$, wherein $R^4$ and $R^5$ each represents a hydrogen atom, an alkyl group such as methyl, ethyl etc., or an aryl group such as phenyl, etc., such as an amino group, a dimethylamino group, and the like. Of these groups, those containing not more than 16, and particularly not more than 10, carbon atoms in total are more advantageous.

In addition, $R^1$ and $R^2$ or $R^2$ and $R^3$ may combine with each other to form a 5- or 6-membered ring.

The compounds of formula (I) in which the substituents $R^1$, $R^2$ and $R^3$ each represents a lower alkyl group (containing not more than 6 carbon atoms), or the substituents $R^1$ and $R^2$ combine with each other to form a ring are of greater advantage. In particular, the compounds having a lower alkyl group as the above-described substituent are preferred over others.

Specific examples of the compounds represented by formula (I) of the present invention are illustrated below.

1.
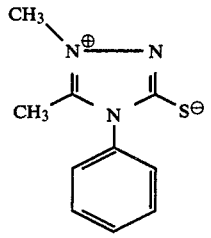
2.
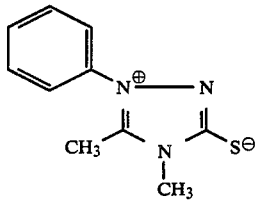
3.
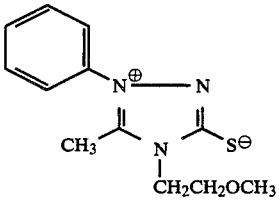
4.
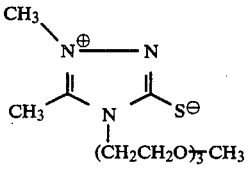
5.
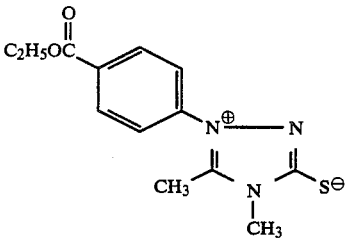
6.
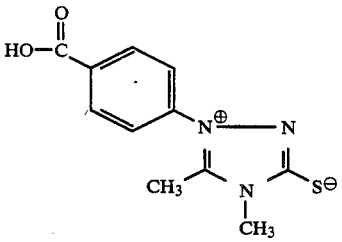
7.
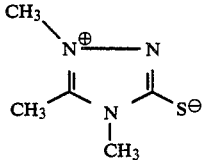
-continued
8.
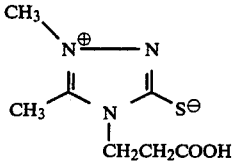
9.
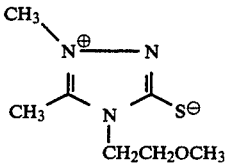
10.
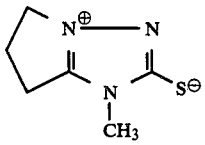
11.
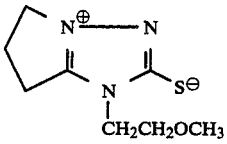
12.
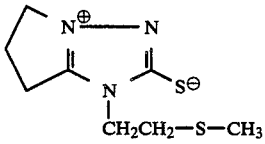
13.
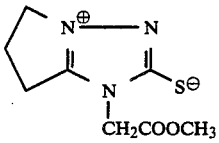
14.
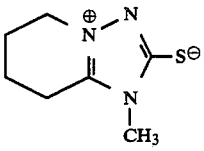
15.
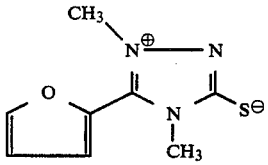
16.
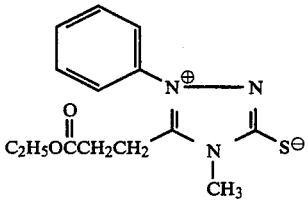

-continued

17.

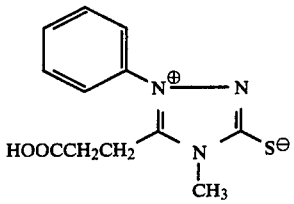

18.

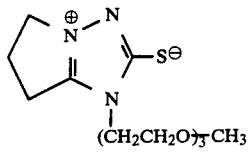

19.

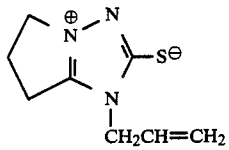

20.

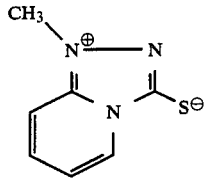

21.

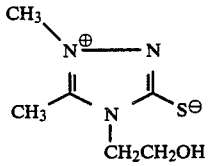

22.

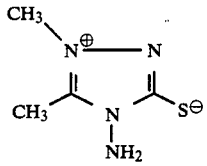

The compounds to be employed in the present invention can be synthesized by conducting (i) anhydroacylation of 1,4-disubstituted thiosemicarbazides, (ii) heating of 4-acyl-1,4-disubstituted thiosemicarbazides, (iii) reaction of N-aminoamidines with thiophosgene, (iv) reaction of N-aminoamidines or N-thioacylhydrazines with isothiocyanic acid, (v) reaction of N-aminoamidines or N-thioacylhydrozines with carbon disulfide-dicyclohexylcarbodiimide, (vi) reaction of meso-ion 1,3,4-thiadiazoles or their corresponding methiodides with primary amines, or so on. Further details of synthesis methods of the compounds of the present invention are described in the following literature and in references cited therein. Specifically, the compounds to be employed in the present invention can be synthesized according to the synthesis methods described in, for instance, W. Baker and W. D. Ollis, *Chem. Ind.* (London), p. 910 (1955); M. Ohta and H. Kato, *Nonbenzenoid Aromatics,* (J. P. Snyder, ed.); K. T. Potts, S. K. Roy and D. P. Jones, *J. Heterocycl. Chem.*, Vol. 2, p. 105 (1965); K. T. Potts, S. K. Roy and D. P. Jones, *J. Org. Chem.*, Vol. 32, p. 2245 (1967); G. F. Duffin, J. D. Kendall and H. R. J. Waddington, *J. Chem. Soc.*, p. 3799 (1959); R.L. Hinmann and D. Fulton, *J. Amer. Chem. Soc.*, Vol. 80, p. 1895 (1958); W. D. Ollis and C. A. Ramsden, *Chem. Commun.*, p. 1222 (1971); W.D. Ollis and C.A. Ramsden, *J. Chem. Soc., Perkin. Trans. I,* p. 633 (1974); and R. Grayshey, M. Baumann and R. Hamprecht, *Tetrahedron Lett.*, p. 2939 (1972).

Specific synthesis examples of some of the compounds of formula (I) of the present invention are illustrated in detail below.

SYNTHESIS EXAMPLE 1

Synthesis of Compound 2

108 g of phenylhydrazine was dissolved in 500 ml of benzene and thereto 73 g of methylisothiocyanate was added dropwise. The reaction mixture was heated and refluxed. As the reaction proceeded, crystals separated out. These were filtered off and dried. Thus, 122 g of 4-methyl-1-phenylthiosemicarbazide was obtained.

This compound was able to be used for further reaction without receiving additional purification. A 18.1 g portion of 4-methyl-1-phenylthiosemicarbazide was mixed with 25 ml of acetic acid under room temperature and thereto 25 ml of acetic anhydride was further added. The resulting mixture was refluxed as heating was continued for a period of 8 hours. As the reaction proceeded, crystals separated out. After cooling, the crystals were filtered off, and recrystallized from a methanol-acetic acid mixture. Thus, Compound 2 was obtained as colorless crystals. Yield 13.2 g (64.4%), Melting point 290°–292° C.

SYNTHESIS EXAMPLE 2

Synthesis of Compound 3

11.7 g of 2-methoxyethyl isothiocyanate was dissolved in benzene with stirring and thereto 11.9 g of phenylhydrazine was added under room temperature. Then, the mixture was refluxed as heat was applied thereto. After the reaction was allowed to continue for 6 hours, the reaction mixture was cooled and thereby crystals were precipitated. The crystals were filtered off. Yield 66.7%. The thus obtained 4-(2-methoxyethyl)-1-phenylthiosemicarbazide was usable in the further reaction without receiving any purification treatments.

A 10.0 g portion of the thus obtained 4-(2-methoxyethyl)-1-phenylthiosemicarbazode was dissolved in 15 ml of acetic acid with stirring and thereto 15 ml of acetic anhydride was further added. The resulting mixture was refluxed for 8 hours as heat was applied thereto. After the conclusion of the reaction, the reaction mixture was cooled, and the solvent contained was distilled away. The residue was chromatographed over silica gel for the purposes of separation and purification. Thereafter, the product was recrystallized from an isopropyl alcohol-diethyl ether mixture. Yield 2.1 g (19.0%), Melting Point 108°–109° C.

SYNTHESIS EXAMPLE 3

Synthesis of Compound 10

γ-Bromobutyric acid and quintuple as much hydrazine hydrate as γ-bromobutyric acid by mol were dissolved in mechanol, and refluxed for 7 hours as heat was applied thereto. After methanol was distilled away under reduced pressure, the residue was chromatographed using an alumina column and the eluate from the column was collected. A methanol/chloroform (1/20) mixture was used as the eluant. Upon removal of the eluant from the eluate by distillation, 1-amino-2-pyrrolidinone was obtained.

A 10 g portion of 1-amino-2-pyrrolidinone was dissolved in toluene and thereto 7.3 g of methyl isothiocyanate was added. The resulting mixture was refluxed for 3 hours as heat was applied thereto. After cooling, crystals precipitated were filtered off and dried. The thus obtained crystals were identified as 1-(2-pyrrolidinone-1-yl)-3-methylthiourea by NMR and Mass Spectra analysis.

A 14 g portion of 1-(2-pyrrolidinone-1-yl)-3-methylthiourea was added to 20 ml of acetic acid and stirred. Thereto, 20 ml of acetic anhydride was further added, and the resulting mixture was refluxed under heating. After the conclusion of the reaction, the solvent was distilled away and the product was recrystallized from ethanol. Yield 3.4 g (27.1%), Melting Point 257°–259° C.

SYNTHESIS EXAMPLE 4

Syntheses of Compound 16 and Compound 17

A 18.1 g portion of 4-methyl-1-phenylthiosemicarbazide produced in Synthesis Example 1 was mixed with 100 ml of toluene and thereto 18.1 g of β-carboethoxypropionyl chloride was added and heat was applied. After 3 hour heating at 80° C., the reaction mixture was cooled to precipitate crystals. These crystals were identified as 4-methyl-1-phenyl-1-(β-carboethoxypropionyl)thiosemicarbazide. A 10 g portion of this compound was suspended in 70 ml of ethanol and refluxed under heating. Upon addition of a small amount of sodium ethoxide to the refluxing solution, the reaction mixture became temporarily homogeneous and then crystals separated out. After cooling, the crystals were filtered off and dried. Thus, Compound 16 was obtained. Yield 16.0 g (55%), Melting Point 162°–163° C.

A 10 g portion of the thus obtained Compound 16 was added to 20 ml of 6 N hydrochloric acid and thereto 40 ml of ethanol was further added. The resulting suspension was refluxed for 1 hour under heating, and converted into a homogeneous solution. The solution was evaporated to dryness, and the residue was recrystallized from ethanol. Thus, Compound 17 was obtained. Yield 5.5 g (60.9%), Melting Point 223°–225° C.

Although some of the compounds of formula (I) of the present invention are already known in the photographic art through descriptions, for example, in European Pat. No. 54415A1 (corresponding to U.S. Pat. No. 4,378,424) and so on, such compounds have previously been used only as a stabilizing agent in heat developable silver halide photosensitive materials and as a fixing agent in photographic development processing. Accordingly, the purpose of using the compounds, the effect achieved by the compounds, and the use of them in accordance with the present invention are quite different from such prior uses.

In addition, the compounds of formula (I) of the present invention not only enable formation of silver halide grains which are nearly uniform in size, and of large size, but also ensures higher sensitivity to a silver halide emulsion than ammonia, for silver halide grains having the same mean grain size.

In the present invention, a silver halide emulsion in which silver halide grains formed in the presence of a silver halide solvent represented by formula (I) are present is employed.

Preferably, the emulsion of the present invention is prepared in a process comprising the step of reacting a water-soluble silver salt with a water-soluble halide in a liquid reaction medium (e.g., an aqueous solution of a hydrophilic colloid) containing a silver halide solvent represented by the foregoing formula (I).

The silver halide solvent represented by formula (I) may be added to the system for preparing the silver halide at any stage in the preparation where the size and the shape of the silver halide grains have not yet reached the size and the shape desired.

The silver halide solvent of formula (I) may be added, for example, to a colloidal material in which silver halide is to be precipitated. Alternatively, the silver halide solvent of formula (I) and either of salts from which silver halide can be prepared, that is, either of a water-soluble silver salt (e.g., silver nitrate) or a water-soluble halide (e.g., an alkali metal halide such as potassium bromide, sodium chloride, and the like), may be added in combination. Moreover, the silver halide solvent of formula (I) may be added prior to or during the physical ripening of the silver halide.

The amount of the silver halide solvent represented by formula (I) in the present invention can be varied over a wide range depending upon the desired extent to which the effect of the silver halide solvent is to be achieved, the kind of compound used, and so on. In general, a suitable amount of the compound represented by formula (I) ranges from about $1\times10^{-5}$ mol to $5\times10^{-1}$ mol per mol of silver halide to be formed. Especially good results are obtained when the compound represented by formula (I) is employed in a range of from about $3\times10^{-4}$ to about $1\times10^{-1}$ mol per mol of silver halide.

In addition, the compound of the present invention can also be used together with a known silver halide solvent, with specific examples including ammonia, potassium thiocyanate and compounds described in U.S. Pat. No. 3,271,157, Japanese Patent Application (OPI) Nos. 12360/76, 82408/78, 144319/78, 100717/79 and 155828/79 (the term "OPI" as used herein refers to a "published unexamined Japanese patent application"), and so on, as occasion arises.

The emulsion employed in the present invention can be prepared using various methods as described in, for example, P. Glafkides, *Chimie et Physique Photographique,* Paul Montel, Paris (1967); G. F. Duffin, *Photographic Emulsion Chemistry,* The Focal Press, London (1966); and V. L. Zelikman, et al., *Making and Coating Photographic Emulsion,* The Focal Press, London (1964).

Suitable methods for reacting a water-soluble silver salt with a water-soluble halide include, e.g., a single jet method, a double jet method, or a combination thereof.

Also, a so-called controlled double jet method, in which the pAg of the liquid phase in which silver halide grains are to be precipitated is maintained constant, may be employed in the present invention.

The silver halide emulsion of the present invention is, in general, prepared under conditions of a temperature ranging from about 30° C. to about 90° C., and pAg ranging from about 6 to 13 (which varies depending on the temperature). The pH value should be adjusted to around neutrality (about 6 to 8) when rapid grain growth is desired, whereas when it is desired to slow down the rate of grain growth the pH value should be selected from an acidic region or an alkaline region.

In a process for producing silver halide grains or allowing the produced silver halide grains to ripen physically, cadmium salts, zinc salts, lead salts, thallium salts, iridium salts and complexes thereof, rhodium salts and complexes thereof, iron salts and complexes thereof and/or the like may be present.

Examples of silver halides which may be present in the silver halide emulsion of the present invention include silver bromide, silver iodide, silver chloride, silver chlorobromide, silver bromoiodide, silver chlorobromoiodide, and so on.

A suitable mean diameter of the silver halide grains contained in the silver halide photographic emulsion prepared in accordance with the present invention ranges from about 0.1 micron to 4 microns. Particularly, silver halide grains having a mean diameter of from about 0.2 micron to 2 microns provide good results.

The interior and the surface of the silver halide grains may differ, or the silver halide grains may be uniform throughout. Further, either silver halide grains of the kind which form latent image predominantly at the surface of the grains, or grains of the kind which form latent image mainly inside the grains can be used.

Removal of the soluble salts from the silver halide emulsion of the present invention is, in general, carried out after the formation of the silver halide grains or after physical ripening. The removal can be effected using the well-known noodle washing method which comprises gelling the gelatin, or using a sedimentation process (thereby causing flocculation in the emulsion) taking advantage of a sedimenting agent such as a polyvalent anion-containing inorganic salt (e.g., sodium sulfate), an anionic surface active agent, an anionic polymer (e.g., polystyrenesulfonic acid), or a gelatin derivative (e.g., an aliphatic acylated gelatin, an aromatic acylated gelatin, an aromatic carbamoylated gelatin or the like). The removal of soluble salts from the silver halide emulsion may be omitted.

The silver halide emulsion of the present invention can be a so-called primitive emulsion, that is to say, a chemically unsensitized emulsion. However, it is usual for the emulsion of the present invention to also be chemically sensitized. Chemical sensitization can be carried out using processes described in P. Glafkides, supra, V. L. Zelkiman et al., supra, or H. Frieser, *Die Grundlagen der Photographischen Prozesse mit Silberhalogeniden*, pp. 675-734, Akademische Verlagsgesellschaft (1968).

More specifically, sulfur sensitization using compounds containing sulfur capable of reacting with silver ion or active gelatin, reduction sensitization using reducing materials, noble metal sensitization using gold or other noble metal compounds and so on can be employed individually or as a combination thereof. Examples of suitable sulfur sensitizers which can be used include thiosulfates, thioureas, thiazoles, rhodanines and other sulfur-containing compounds. Examples of suitable reducing sensitizers which can be used include stannous salts, amines, hydrazine derivatives, formamidine sulfinic acid, silane compounds and so on. Group VIII metal complexes, such as those of platinum, iridium, palladium, etc., in addition to gold metal complexes can be employed for the purpose of sensitization with a noble metal, and specific examples of these complexes are described in U.S. Pat. Nos. 2,399,083 and 2,448,060, British Pat. No. 618,061, and so on.

The photographic emulsions of the present invention may be spectrally sensitized using methine dyes or other dyes. Suitable spectral sensitizers which can be employed include cyanine dyes, merocyanine dyes, complex cyanine dyes, holopolar cyanine dyes, hemicyanine dyes, styryl dyes and hemioxonol dyes. Especially useful dyes are cyanine dyes, merocyanine dyes and complex merocyanine dyes.

The silver halide emulsions prepared in accordance with the present invention can be converted to direct positive emulsions by fogging the silver halide grains present therein. Further, direct positive silver halide emulsion with high photographic sensitivity can be obtained by doping the silver halide grains prepared in the presence of the compounds of formula (I) with metal ions originated from iridium salts, rhodium salts, lead salts, and so on. Also, the silver halide emulsions of the present invention may be doped metal ion-free direct positive emulsions. The fogging can be attained by treating the silver halide grains chemically or physically using known methods.

When employed for producing a direct positive light-sensitive material, the silver halide emulsion of the present invention can contain a desensitizer or a desensitizing dye, and a so-called electron acceptor, not to speak of the above-described sensitizing dyes.

The photographic emulsions of the present invention may contain, for example, polyalkylene oxides and derivatives thereof, such as the ethers, the esters and the amines thereof, thioether compounds, thiomorpholines, quaternary ammonium salt compounds, urethane derivatives, urea derivatives, imidazole derivatives, 3-pyrazolidones and so on in order to increase the sensitivity and the contrast thereof, or in order to accelerate the developing rate thereof.

Gelatin (including lime-processed gelatin, acid-processed gelatin, enzyme-processed gelatin, and the like) is employed to advantage as a binder or a protective colloid of the photographic emulsion. Hydrophilic colloids other than gelatin can also be used. For instance, other colloids that can be used include proteins such as gelatin derivatives, graft copolymers of gelatin and other high polymers, albumin, casein, etc.; sugar derivatives such as cellulose derivatives (e.g., hydroxyethyl cellulose, carboxymethyl cellulose, cellulose sulfate, etc.), sodium alginate, starch derivatives and the like; and various kinds of synthetic hydrophilic macromolecular substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and so on.

The photographic emulsions to be employed in the present invention can contain a wide variety of compounds for purposes of preventing fogging and stabilizing photographic functions during production, storage or photographic processing. More specifically, azoles such as benzothiazolium salts, nitroindazoles, triazoles, benzotriazoles, benzimidazoles (especially those substituted with nitro group or halogen atoms) and so on; heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazoles), mercaptopyrimidines and so on; the above-described heterocyclic mercapto compounds containing a water-soluble group such as carboxyl group, sulfo group or the like; thioketo compounds like oxazolinethione; azaindenes such as tetraazaindenes (especially (1,3,3a,7)tetraazaindenes substituted with a hydroxy group at the 4-position); benzenethiosulfonic acids; benzenesulfinic acids; and other many compounds known as an antifoggant or a stabilizer can be added to the photographic emulsion of the present invention.

The photographic emulsion layers or other hydrophilic colloid layers which constitute the photographic materials of the present invention may contain inorganic or organic hardeners.

Examples of hardeners that may be used include chrome salts (e.g., chrome alum, chromium acetate, etc.), aldehyde compounds (e.g., formaldehyde, glyoxal, glutaraldehyde etc.), N-methylol compounds (e.g., dimethylolurea, methyloldimethylhydantoin, etc.), dioxane derivatives (e.g., 2,3-dihydroxydioxane, etc.), active vinyl compounds (1,3,5-triacryloyl-hexahydro-s-triazine, 1,3-vinylsulfonylmethyl-2-propanol, etc.), active halogen compounds (2,4-dichloro-6-hydroxy-s-triazine, etc.), and mucohalogen acids (e.g., mucochloric acid, mucophenoxychloric acid, etc.), alone or as a combination thereof.

The photographic emulsion layers or other hydrophilic colloid layers of the present photosensitive materials mav contain surface active agents for various purposes, such as coating aids, prevention of electrification, improvement of slipping properties, emulsification and dispersion, prevention of adhesion, and improvement of photographic characteristics (e.g., development acceleration, high contrast, and sensitization, and so on).

Examples of surface active agents which can be employed include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic acid polyglycerides, alkylphenol polyglycerides, etc.), fatty acid esters of polyhydric alcohols, alkyl esters of sugar, and so on; anionic surface active agents containing acid groups (e.g., carboxyl group, a sulfo group, a phospho group, a sulfate group, a phosphate group, etc.), such as alkylcarboxylates, alkylsulfonates, alkylbenzenesulfonates, alkylnaphthalenesulfonates, alkylsulfates, alkylphosphates, N-acyl-N-alkyltauric acid, sulfosuccinates, sulfoalkylpolyoxyethylene alkylphenyl ethers, polyoxyethylene alkylphosphates, etc.; amphoteric surface active agents such as amino acids, aminoalkylsulfonates, aminoalkylsulfates, aminoalkylphosphates, alkylbetaines, amine oxides, etc.; and cationic surface active agents such as alkylamines, aliphatic or aromatic quaternary ammonium salts, heterocyclic quaternary ammonium salts like pyridinium, imidazolium and so on, aliphatic or hetero ring-containing phosphonium or sulfonium salts, and so on.

The photographic emulsion layers which constitute the photographic material of the present invention can contain color forming couplers, that is, compounds capable of forming colors by oxidative coupling with aromatic primary amine developing agents (e.g., phenylenediamine derivatives, aminophenol derivatives, etc.) upon color development processing.

Examples of suitable magenta couplers include 5-pyrazolone couplers, pyrazolobenzimidazole couplers, cyanoacetylcumarone couplers, open-chain acylacetonitrile couplers and so on. Examples of suitable yellow couplers include acylacetamide couplers (e.g., benzoylacetanilides, pivaloylacetanilides, etc.) and so on. Examples of suitable cyan couplers include naphthol couplers, phenol couplers, and so on. It is desirable for these couplers to have a structure to prevent diffusion of the couplers, for example, a hydrophobic group functioning as a ballast group. These couplers may be either 2-equivalent or 4-equivalent to silver ion. Colored couplers having a color correction effect, or couplers capable of releasing a development inhibitor upon development (so-called DIR couplers) may be incorporated into the photographic emulsions of the present invention. Besides DIR couplers, colorless DIR coupling compounds which can yield colorless products upon the coupling reaction and which can release development inhibitors may also be incorporated.

The photographic emulsions of the present invention can contain dye image forming compounds (e.g., dye developers, dye releasing redox compounds, DDR (difusible dye release) couplers, etc.) to be employed in the so-called diffusion transfer process.

Developing agents can be present in the silver halide emulsions of the present invention. Examples of suitable developing agents which can be employed are described in "Developing Agents" *Research Disclosure* (RD-17643), Vol. 176, p. 29 (1978).

The photographic emulsion layers and/or other hydrophilic colloidal layers of the photosensitive material produced in accordance with the present invention may contain dyes such as filter dyes, antihalation dyes or dyes for other various purposes. Examples of such dyes are those described in "Absorbing and Filter Dyes" *Research Disclosure* (RD-17643), Vol. 176, pp. 25 and 26 (1978).

In addition, the silver halide photographic emulsions of the present invention can contain antistatic agents, plasticizers, matting agents, lubricants, ultraviolet absorbing agents, brightening agents, aerial fog inhibitors, and so on.

The silver halide emulsions are coated on a support, optionally together with other photographic layers. Suitable coating techniques which can be used are described in "Coating Procedure" *Research Disclosure* (RD-17643), Vol. 176, pp. 27-28 (1978).

Suitable supports which can be employed are described in "Supports" *Research Disclosure* (RD-17643), Vol. 176, p. 28 (1978).

The silver halide photographic emulsions of the present invention can be used in various ways; examples are set forth below.

The silver halide emulsions can be used as color positive emulsions, color paper emulsions, color negative emulsions, color reversal emulsions (with or without couplers), emulsions for photographic materials suitable for graphic arts (e.g., lithographic films), emulsions used in photosensitive materials for recording a cathode-ray tube display, emulsions used in photosensitive materials for X-ray recording (particularly for direct and indirect X-ray photography utilizing a screen), emulsions employed for the colloid transfer process (as described, e.g., in U.S. Pat. No. 2,716,059), emulsions for the silver salt diffusion transfer process, emulsions for the color diffusion transfer process, emulsions for the dye transfer process (imbibition transfer process), emulsions for the silver dye bleach process, emulsions for direct positive photosensitive materials, emulsions for heat developable photosensitive materials, emulsions employed in photosensitive materials for physical development, and so on.

The emulsions of the present invention can, in particular, be utilized to advantage as emulsions employed for multilayered coupler-in-emulsion type color films and more particularly, emulsions for reversal color films and negative color films, emulsions for black and white negative films (including black and white highly sensitive negative films, micro negative films and so on), emulsions for the color diffusion transfer process, and emulsions for direct positive photosensitive materials.

The exposure for obtaining a photographic image may be carried out in a conventional manner. Any various known light sources including natural light (sunlight), a tungsten lamp, a fluorescent lamp, a mercury lamp, a xenon arc lamp, a carbon arc lamp, a xenon flash lamp, cathode-ray tube flying spot and so on can be employed for the exposure. Suitable exposure times which can be used include not only exposure times used commonly in cameras ranging from about 1/1,000 to about 1 sec, but also exposure times shorter than 1/1,000 sec, for example, about $1/10^4$ to about $1/10^6$ sec as used with xenon flash lamps and cathode-ray tubes. Exposure times longer than 1 sec can also be used. The spectral composition of the light employed for the exposure can be controlled using color filters, if desired. Laser beams can also be employed for the exposure. Moreover, the emulsions of the present invention may also be exposed to light emitted from phosphors excited by electron beams, X-rays, $\gamma$-rays, $\alpha$-rays and the like.

The photographic processing for the photosensitive material of the present invention can be effected using any known processing method. Any known processing solution can be employed in the present invention. The processing temperature is generally in the range of about 18° C. to about 50° C. Of course, temperatures higher than about 50° C. or lower than 18° C. may be employed. This photographic processing may be either a photographic processing for forming a silver image (black and white photographic processing) or a color photographic processing comprising the development processing to form a dye image.

EXAMPLE 1

A mixed aqueous solution of potassium bromide and potassium iodide and an aqueous solution of silver nitrate both were simultaneously added dropwise to an aqueous solution of gelatin over a period of 40 minutes at a temperature of 50° C. with vigorous stirring to produce a silver iodobromide emulsion having an iodine content of 2 mol % (Emulsion 1). The value of pAg was maintained at about 9.3 during the silver halide precipitation.

Emulsions were further prepared in the same manner as Emulsion 1 except that the compounds of the present invention as set forth in Table 1 and ammonia, respectively, were added to the above-described gelatin solution in their individual amounts shown in Table 1.

The mean grain size of silver iodobromide grains contained in each of the thus prepared emulsions was determined by observation with the electron microscope.

As can be seen from the data in Table 1, the compounds of the present invention produced a striking effect that addition thereof in only small amounts resulted in a marked increase in grain size.

In addition, the compounds of the present invention do not have at all such a bad odor as ammonia has, and can be handled with ease.

TABLE 1

| Emulsion | Compound Used | Amount Added (mol/mol $AgNO_3$) | Mean Grain Size (μm) |
|---|---|---|---|
| 1 | — | — | 0.20 |
| 2 | Compound 2 | 0.005 | 0.37 |
| 3 | Compound 4 | 0.006 | 0.31 |
| 4 | Compound 7 | 0.002 | 0.35 |
| 5 | Compound 7 | 0.005 | 0.45 |
| 6 | Compound 7 | 0.010 | 0.62 |
| 7 | Compound 9 | 0.002 | 0.40 |
| 8 | Compound 10 | 0.002 | 0.29 |
| 9 | Compound 10 | 0.006 | 0.45 |
| 10 | Compound 18 | 0.002 | 0.32 |
| 11 | Ammonia (Comparison) | 0.10 | 0.45 |

EXAMPLE 2

Emulsion 1 and Emulsions 5, 9 and 11, which had the same large means grain size, were selected from the emulsions prepared in Example 1. Each of these emulsions was washed with water in the conventional manner, and then adjusted to pH, 6.5 and pAg 8.9. The resulting emulsions were subjected to gold-sulfur. sensitization at a temperature of 55° C. using sodium thiosulfate, potassium chloroaurate, and potassium thiocyanate.

To each of the thus chemically sensitized emulsions were added 4-hydroxy-6-methyl-1,3,3*a*,7-tetraazaindene (stabilizer), sodium salt of 2,4-dichloro-6-hydroxy-s-triazine (hardener) and sodium dodecylbenzenesulfonate (coating aid). Then, each emulsion was coated on a cellulose acetate film support and dried.

The thus obtained samples were exposed to light through an optical wedge and then developed at 32° C. for 1 minute using Kodak D-72 developer, followed by, in sequence, stop, fixation, washing, and drying processings. The results obtained are shown in Table 2.

The standard point of the optical density to determine the sensitivity was fog+0.2. The sensitivities are shown as relative values, with Emulsion 1 being taken as 100.

It can be clearly seen from Table 2 that the sensitivity was greatly enhanced in the emulsions which were prepared in the presence of the compounds of the present invention.

In addition, it was quite unexpected that the emulsions of the present invention had higher sensitivities than the emulsion which acquired the same mean grain size by being prepared in the presence of ammonia.

TABLE 2

| Sample | Fog | Relative Sensitivity | Remark |
|---|---|---|---|
| Emulsion 1 | 0.03 | 100 | Control |
| Emulsion 5 | 0.06 | 750 | Present Invention |
| Emulsion 9 | 0.05 | 670 | Present Invention |
| Emulsion 11 | 0.08 | 640 | Comparison |

EXAMPLE 3

To each of the Emulsion Samples 5, 9 and 11 obtained in Example 2 were added, in sequence, a magenta coupler emulsion (containing, as the coupler, 1-(2,4,6-trichlorophenyl)-3-[3-(2,4-di-t-acylphenoxyacetamido) benzamido]-5-pyrazolone and, as the coupler solvent, tricresyl phosphate), and the same stabilizer, hardener, and coating aid as used in Example 2. The resulting emulsions were each coated on a cellulose acetate film support and dried.

The thus obtained samples were exposed to light through an optical wedge, and subjected to the following color development processing.

The standard point of the optical density to determine the sensitivity was the same as in Example 2, but the results are shown as relative values of Emulsion 10 as 100.

The development processing employed herein comprised the following steps, and all the steps were carried out at 38° C.

| | |
|---|---|
| 1. Color Development | 1 min 30 sec |
| 2. Bleaching | 6 min 30 sec |
| 3. Washing | 3 min 15 sec |
| 4. Fixation | 6 min 30 sec |
| 5. Washing | 3 min 15 sec |
| 6. Stabilization | 3 min 15 sec |

Compositions of the processing solutions used in the above-described steps respectively were described below.

| | |
|---|---|
| Color Developing Solution: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution: | |
| Ammonium Bromide | 160.0 g |
| Aqueous Ammonia (28%) | 25.0 cc |
| Sodium Ethylenediaminetetraacetonato-ferrate (III) | 130.0 g |
| Glacial Acetic Acid | 14.0 cc |
| Water to make | 1 liter |
| Fixing Solution: | |
| Sodium Tetrapolyphosphate | 2.0 g |
| Sodium Sulfite | 4.0 g |
| Ammonium Thiosulfate (70%) | 175.0 cc |
| Sodium Hydrogensulfite | 4.6 g |
| Water to make | 1 liter |
| Stabilizing Solution: | |
| Formaldehyde | 8.0 cc |
| Water to make | 1 liter |

As can be seen from the data in Table 3, the presence of the compounds of the present invention resulted in a low fog level and high sensitivity compared with that of ammonia being used in the color photographic processing also.

TABLE 3

| Sample | Fog | Relative Sensitivity | Remark |
|---|---|---|---|
| Emulsion 5 | 0.12 | 121 | Present Invention |
| Emulsion 9 | 0.10 | 108 | Present Invention |
| Emulsion 11 | 0.18 | 100 | Comparison |

While the invention has been described in detail and with reference to specific embodiments thereof, it will be apparent to one skilled in the art that various changes and modifications can be made therein without departing from the spirit and scope thereof.

What is claimed is:

1. A method for forming a silver halide emulsion comprising forming silver halide grains in the presence of a compound represented by formula (I), said compound being present during precipitation of said silver halide grains or thereafter until during physical ripening of said grains,

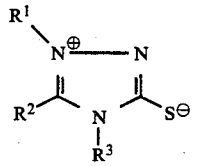

(I)

wherein $R^1$ and $R^2$ each represents an unsubstituted or substituted alkyl group, alkenyl group, cycloalkyl group, aralkyl group, aryl group, or heterocyclic group; $R^3$ represents an unsubstituted or substituted alkyl group, alkenyl group, cycloalkyl group, aralkyl group, aryl group, $—NR^4R^5$, or a heterocyclic group, and $R^4$ and $R^5$ each represents a hydrogen atom, an alkyl group, or an aryl group; and wherein $R^1$ and $R^2$ or $R^2$ and $R^3$ can combine with each other to form a 5- or 6-membered ring.

2. A method as in claim 1, wherein each of $R^1$, $R^2$ and $R^3$ contains not more than 6 carbon atoms.

3. A method as in claim 2, wherein $R^3$ contains not more than 10 carbon atoms.

4. A method as in claim 1, wherein $R^1$, $R^2$ and $R^3$ each represents a lower alkyl group containing not more than 6 carbon atoms, or $R^1$ and $R^2$ can combine with each other to form a 5- or 6-membered ring.

5. A method as in claim 1, wherein the compound represented by formula (I) is used in an amount of from about $1\times10^{-5}$ to $5\times10-1$ mol per mol of silver halide.

6. A method as in claim 2, wherein the compound represented by formula (I) is used in an amount of from about $1.10\times10^{-5}$ to $5\times10^{-1}$ mol per mol of silver halide.

* * * * *